US006565227B1

(12) United States Patent
Davis

(10) Patent No.: US 6,565,227 B1
(45) Date of Patent: May 20, 2003

(54) METHOD AND DEVICE FOR TOOL ALIGNMENT

(76) Inventor: Greg Davis, 717 Transom Way, Oxnard, CA (US) 93035

( * ) Notice: Subject to any disclaimer, the term of this patent is extended or adjusted under 35 U.S.C. 154(b) by 0 days.

(21) Appl. No.: 10/007,718

(22) Filed: Nov. 13, 2001

(51) Int. Cl.[7] ..... F21W 131/00
(52) U.S. Cl. ..... 362/119; 362/311
(58) Field of Search ..... 362/119, 311

(56) References Cited

U.S. PATENT DOCUMENTS 2,822,615 A * 2/1958 Durst et al. ..... 362/119
2,855,679 A * 10/1958 Gibble ..... 362/119

* cited by examiner

*Primary Examiner*—Laura K. Tso
(74) *Attorney, Agent, or Firm*—D. Morgan Tench

(57) ABSTRACT

The present invention is a device and method for aligning a hand drill so that holes can be drilled at a desired angle in a workpiece. A light source and a template are attached to the drill so that an image is projected onto the workpiece surface. For drilling holes perpendicular to the surface, the direction of the projected light beam is parallel to the axis of the drill bit. The preferred image is comprised of two concentric circles and two perpendicular straight lines of equal length whose midpoints correspond with the center of the circles. The two lines preferably have discontinuities of equal length at their midpoints so as to be comprised of segments of equal length. When the drill is not properly aligned relative to the workpiece, the projected circles appear oval in shape and at least some of the lines or line segments differ in length. The eye can readily discern these image distortions so that the drill can be readily adjusted to the desired angle.

19 Claims, 5 Drawing Sheets

METHOD AND DEVICE FOR TOOL ALIGNMENT

BACKGROUND OF THE INVENTION

1. Field of the Invention

This invention is concerned with mechanical tools, and in particular with hole drills.

2. Description of the Related Art

It is often desirable to align a hand drill so that holes can be drilled at a specific angle, perpendicular for example, with respect to a surface of a workpiece. Mechanical devices for accomplishing such alignment are commercially available but suffer from major drawbacks.

For example, the PORTALIGN device (Portalign Tool Company, San Diego, Calif.) is made of metal and utilizes an adapter spindle having a shaft that is threaded on one end and has a threaded hole on the other end. To install this device, the drill bit chuck is removed from the drill, the threaded hole on the adapter spindle shaft is screwed onto the threaded shaft of the drill, and the chuck is screwed onto the threaded end of the adapter spindle shaft. The adapter spindle is connected to the shaft via a bushing so that the spindle remains stationary when the shaft rotates. The adapter spindle has two arms about two inches long that are perpendicular to the shaft and have holes parallel with the shaft on their ends. Metal rods that serve as guides slip fit through the holes in the adapter spindle and in a base ring, which has a bottom surface that is flat and perpendicular to the guide holes. The base ring has thumb screws (in threaded holes) that are tightened against the guide rods to lock them in a given position. For drilling holes perpendicular to a workpiece, the bottom surface of the base ring is pressed against the surface of the workpiece with the guide rods locked in place so as to not protrude past the base ring bottom. For drilling holes at an angle to the workpiece, the guide rods are locked so as to protrude beyond the base ring bottom, and the two guide rods and an edge of the base ring are pressed against the workpiece surface.

The PORTALIGN device is inconvenient to use and has significant limitations. The overall length of the drill is increased by the length of the adapter spindle (about 4 inches), which has to be removed when access to the workpiece is limited (by an opposing structure, for example). Removal of the adapter spindle requires a significant amount of time, as well as tools to clamp and turn the chuck and to prevent the drill shaft from turning. In addition, the PORTALIGN device cannot be used to drill holes near an obstruction or sidewall (in a corner, for example) because of the space required for the base ring. Furthermore, both of the operator's hands are required for the drilling operation, one to hold the drill and the other to hold the PORTALIGN base ring against the workpiece surface. Also, the guide rods need to be lubricated and protected from corrosion so that they will move freely through the guide holes in the adapter spindle.

A simple approach to drilling holes perpendicular to a workpiece is to use a drill bit guide comprised of a cylinder having a concentric hole slightly larger than the drill bit diameter. In this case, one end of the cylinder has a flat surface perpendicular to the cylinder axis that is pressed against the workpiece. Such a drill bit guide requires a separate tool (which may be an insert) for each drill bit size. For drilling holes at other angles, separate tools would be required for all combinations of angles and hole diameters. As with the PORTALIGN device, a drill bit guide must also be held against the workpiece during the drilling operation and has a finite diameter that limits the conditions of use.

Optical devices involving a focused light source and a means for detecting light reflected from the workpiece surface could also be used for drill alignment. In this case, the light source and detector would be arranged so that a maximum in the intensity of the reflected light would occur when the drill bit was at the desired angle. This approach is unnecessarily complicated and would not work well for workpiece surfaces with low reflectance. The light source and the detector would have to be located in very close proximity or a relatively sophisticated electronic system would be required to compensate for the difference in their locations. Alignment between the light source and detector would be critical and difficult to maintain. The most significant disadvantage of this approach, however, is the electronic feedback provided for attaining alignment. Visual readout of the information (via a digital display, for example) would detract attention of the operator from the workpiece, and audio readout would be inaccurate.

SUMMARY OF THE INVENTION

The present invention is a device and method for aligning a hand tool so that holes, slots or grooves can be drilled or cut at a desired angle to the surface of a workpiece. Essentially, a device for projecting an image is attached to the hand tool whose orientation is adjusted until no distortion of an image projected onto an area of the workpiece surface is observed This invention is particularly useful for drilling holes at a desired angle and is described with respect to this embodiment.

The device of this invention comprises a light source and a template that are attached to the drill and positioned so as to produce a beam of light that projects an image onto an area of the workpiece surface. The light source and template may be attached to the drill separately but are preferably contained and constrained within a projector housing, which is attached to the drill. An incandescent bulb is preferred but a variety of other light sources could be used, including a in fluorescent light, a laser or a light emitting diode (LED). Power for the light source may be provided by an electrical storage battery or by an alternating current source. The template may be a layer of transparent or translucent glass or plastic material with an image pattern applied by scribing, drilling, cutting, etching, printing, stenciling, stamping, molding or other means, and combinations thereof. The image itself, or improved contrast thereof, may be provided by a pigment or ink. Alternatively, the template may be an opaque material with the image defined by cutout areas. The device may include a curved reflector behind the light source to intensify and/or collimate or focus the light beam used to project the image. The device may also include a lens or lens system to focus the image on the workpiece surface or to adjust the size of the image for optimum sensitivity to the drill orientation. For example, the size of the image may be enlarged for ease of viewing or be reduced to avoid workpiece surface irregularities or adjacent interfering obstructions. Preferably, the light source and template, a reflector, a storage battery and any lenses employed are contained in a plastic or metallic cylindrical projector housing. A suitable projector device is a battery-powered flashlight with a template added for projecting an image. In the simplest embodiment, part of the projector housing serves as the template and a separate template is not required.

The projector device may be attached to the drill by any means providing the rigidity needed to maintain the required orientation with respect to the drill. A preferred attachment means is an open cylindrical clamp (metallic or plastic) that holds a cylindrical projector via spring action and has a flat base that is screwed to the drill. A piece of relatively soft material, such as rubber, may be interposed between the drill and the clamp or between the clamp and the projector to dampen vibrations produced when the drill is operating. For drilling holes perpendicular to the workpiece surface, the device is attached to the drill so that the direction of the projected beam is parallel with the axis of the drill bit. The projector device may be attached to the drill via a pivot with a locking device (a set screw, for example) that allows the angle of the projected beam to be adjusted relative to the drill bit so that the device can be used to drill holes at angles other than 90° to the workpiece surface. The pivot assembly may include a reference mark and calibration marks to allow the device to be readily adjusted for a specific drill bit angle.

The method of the present invention involves adjusting the orientation of the drill until the image projected by the projector device of the invention (attached to the drill) is visually observed to exhibit substantially no elongation associated with impingement of the light beam at an oblique angle to the workpiece surface. For drilling holes perpendicular to the surface, the projector device is attached to the drill so that the direction of the projected light beam is parallel to the axis of the drill bit. For drilling holes at other angles relative to the perpendicular, the projector device is positioned so that the projected light beam is coplanar and at the desired angle with respect to the drill bit.

The present invention has significant advantages compared to prior art devices and methods. The device is simple, easily attached (and detached) and easy to use. It also does not increase the overall length of the drill and can be used for drilling holes near sidewalls or other obstructions. Since the projector device is rigidly attached to the drill, both of the operator's hands can be used for the drilling operation itself, which improves safety. In addition, good accuracy and reduced costs are attained by detecting alignment via the combination of the human eye and brain, which are very sensitive to image distortion, particularly when the image is comprised of regular geometric patterns. In addition, the image is projected on the workpiece and the process of attaining and maintaining alignment is intuitive so that operator attention is not significantly diverted from the drilling operation, which is a significant safety benefit.

Further features and advantages of the invention will be apparent to those skilled in the art from the following detailed description, taken together with the accompanying drawings.

DETAILED DESCRIPTION OF THE INVENTION

The present invention is a device and method for aligning a hand tool so that holes, slots or grooves can be drilled or cut at a desired angle to the surface of a workpiece. An image is projected onto the surface of the workpiece, or onto a conformal coating or structure thereon, using a projector device attached to the tool at a specific angle with respect to the drill bit or cutting blade. The orientation of the hand tool with respect to the workpiece is then adjusted until no distortion of the image projected onto the workpiece surface is observed. This invention is particularly useful for drilling holes at a desired angle but might also be used with other hand tools, including circular or reciprocating saws and rotary cutting tools, such as routers. For illustrative purposes, the invention is described with respect to hole drills. Note that the term hand tool encompasses both manual and powered tools, including those powered by an electric motor. Also, alignment of the tool with respect to the workpiece surface implicitly means alignment of the drill bit or cutting blade (or bit) with respect to the workpiece surface.

Figure 1:
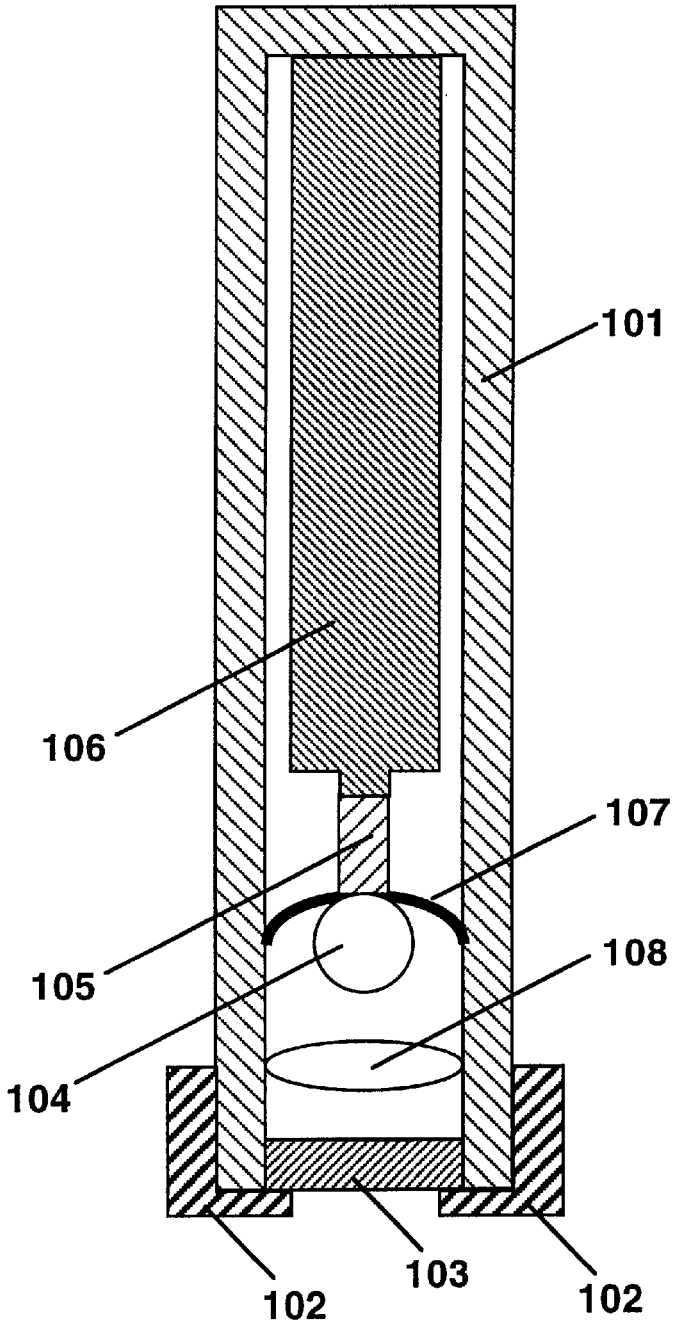
FIG. 1 is a schematic representation of a preferred projector for the device of the present invention.

FIG. 1 is a schematic representation of a suitable projector for the device of the present invention, which includes a cylindrical housing 101, a retaining ring 102, a template 103, a light source 104 having an electrical connector 105, an electrical storage battery 106, a curved reflector 107, and an optional lens 108. Housing 101 and retaining ring 102 may be made of any suitable material, including metals, alloys, plastics and composites, and combinations thereof. Retaining ring 102 may be attached to housing 101 via mating screw threads on each of the two pieces, one or more separate screws, a locking pin and slot, or other means.

Template 103 is a disk of transparent or translucent glass or plastic material with an image pattern applied by scribing, drilling, cutting, etching, printing, stenciling, stamping, molding or other means, or combinations thereof. The image itself, or improved contrast thereof, may be provided by a pigment or ink. Alternatively, template 103 may be an opaque material with the image defined by cutout areas. In the projector of FIG. 1, an outer circle of the projected image is defined by the inside of cylindrical housing 101. Template 103 may be a flat disk or may have a curved surface so as to also serve as a lens for focusing or adjusting the size of the projected image. Template 103 may itself serve as the end piece for housing 101 or a separate transparent or translucent end piece (not shown) may be employed.

Light source 104 is preferably an incandescent bulb of sufficient wattage to provide good image contrast. Alternatively, light source 104 may be a fluorescent light, a laser or a light emitting diode (LED). Power for the light source is preferably provided, via electrical connector 105 and additional electrical circuitry (not shown), by storage battery 106 so that the projector can be easily detached from the tool for storage. Battery 106 is preferably small and inexpensive, AA or AAA size for example, and a plurality of batteries may be used. Alternatively, power for light source 104 may be provided as an alternating current (ac), preferably derived from the tool, if electrically powered, via a readily detachable electrical connector. The electrical circuitry preferably includes a switch (not shown) for conveniently interrupting power to light source 104. A curved reflector 107 is preferably disposed behind light source 104 to intensify and at least partially focus the light beam used to project the image. Optional lens 108 may be used to further focus the light beam or adjust the size of the projected image. Lens 108 may be of any appropriate shape (concave or convex) and may be located in any suitable location. Lens 108 may be attached to movable retaining ring 102 so that lens 108 can be moved relative to light source 104 to focus or adjust the size of the projected image.

The device of the present invention also includes a means of attaching the projector (FIG. 1) to the hand tool. The projector may be an integral part of the tool or be attached permanently, via a weld, for example, or it may be attached so that it can readily be removed, via a spring-loaded clamp or screws or a combination thereof, for example. The particular means of attachment is not critical to the invention although some attachment means will be more convenient than others. Numerous suitable attachment means will be apparent to those skilled in the art.

Figure 2:
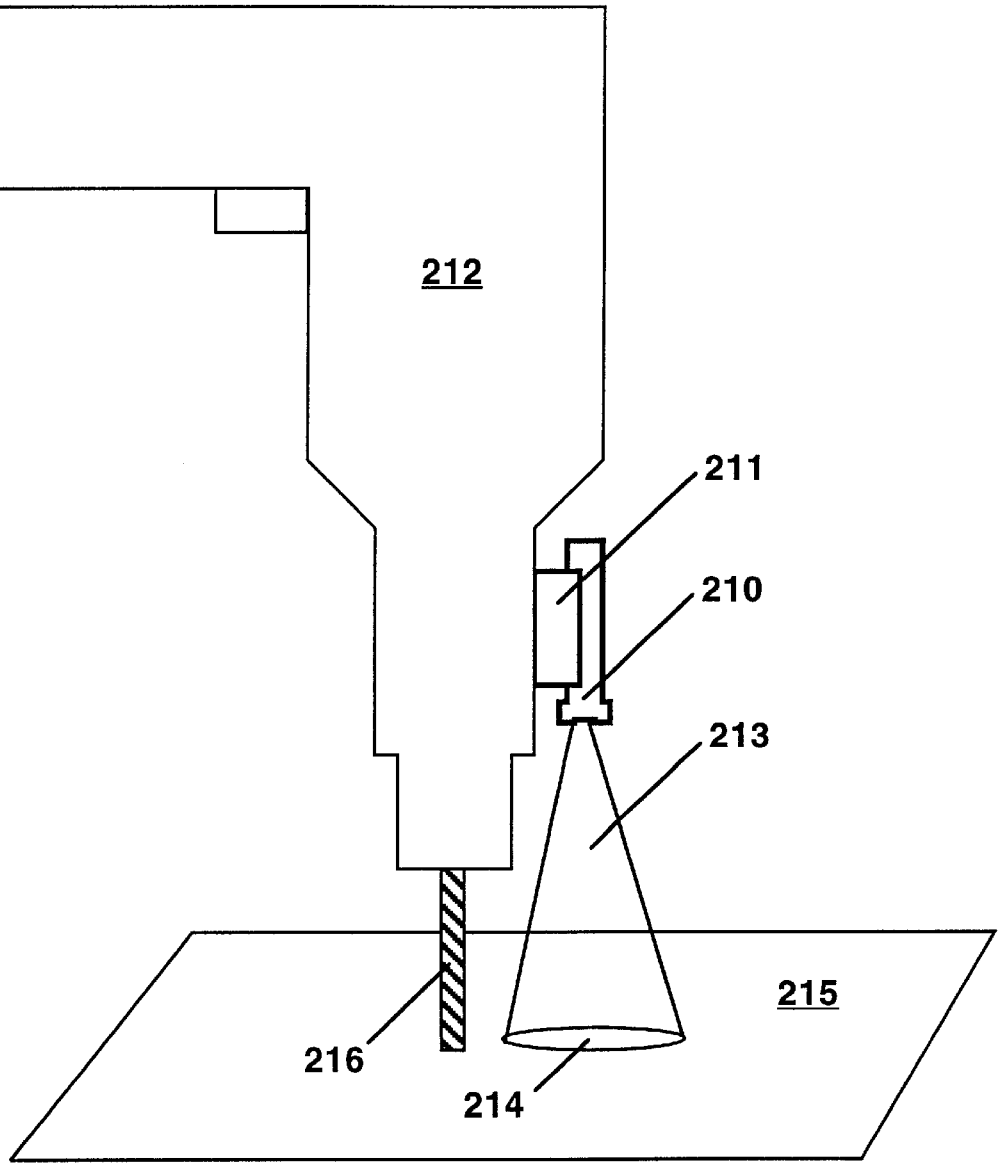
FIG. 2 depicts a projector according to the present invention that is mounted to an electric drill via a fixed bracket for drilling holes perpendicular to the workpiece surface.

FIG. 2 shows a cylindrical projector 210 attached to a hand drill 212 by means of a spring-loaded open cylindrical clip 211, which may be attached to the drill by a screw, for example. The axis of cylindrical projector 210 is parallel with the axis of drill bit 216 so that light beam 213 impinges the workpiece surface 215 perpendicularly when drill bit 216 is perpendicular to the workpiece surface. In this case, image 214 will not be substantially distorted. A hole is drilled perpendicular to as workpiece surface 215 by maintaining the orientation of drill 212 (with respect to the workpiece) so that image 214 remains undistorted. Less control by the operator is required after the hole being drilled reaches an appreciable depth so that it serves as a drill bit guide to help maintain the required orientation.

Figure 3:
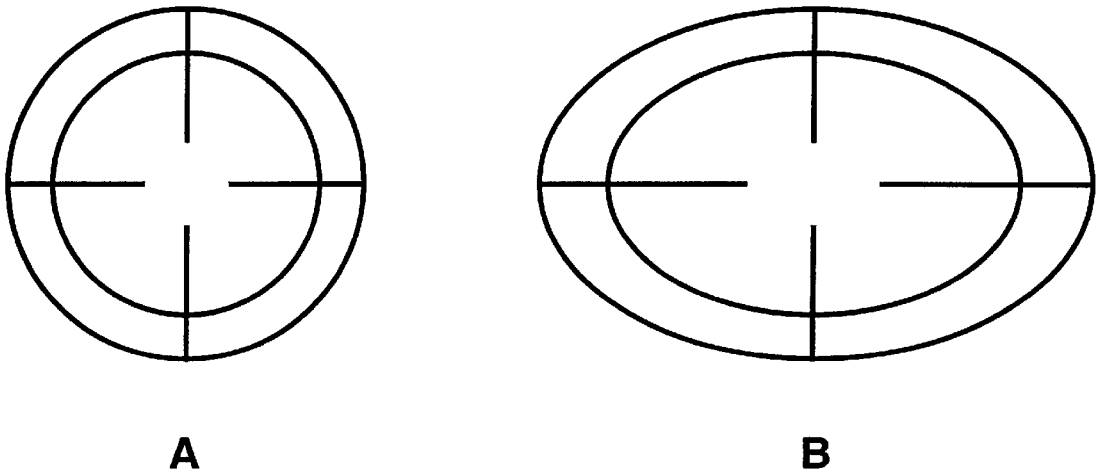
FIG. 3 depicts projections of a preferred image for the present invention when the light beam impinges the surface (A) perpendicularly and (B) obliquely.

FIG. 3 depicts projections of a preferred image for the present invention when the light beam impinges the surface (A) perpendicularly and (B) obliquely. The preferred image is comprised of two concentric circles and two perpendicular straight lines of equal length whose midpoints coincide with the center of the circles. The straight lines may be continuous or, as depicted in FIG. 3(A), have discontinuities of equal length at their midpoints so as to be comprised of segments of equal length. The lines may be contained within the smaller circle or, as depicted in FIG. 3(A), may intersect one or both of the circles. When the light beam impinges the surface perpendicularly, the image is undistorted, as shown in FIG. 3(A). When the drill is not properly aligned and the light beam impinges the surface of the workpiece at an oblique angle, the projected circles appear oval in shape and at least some of the lines or line segments differ in length, as shown in FIG. 3(B). The eye can readily discern these image distortions so that the drill can be readily adjusted to the desired angle.

Figure 4:
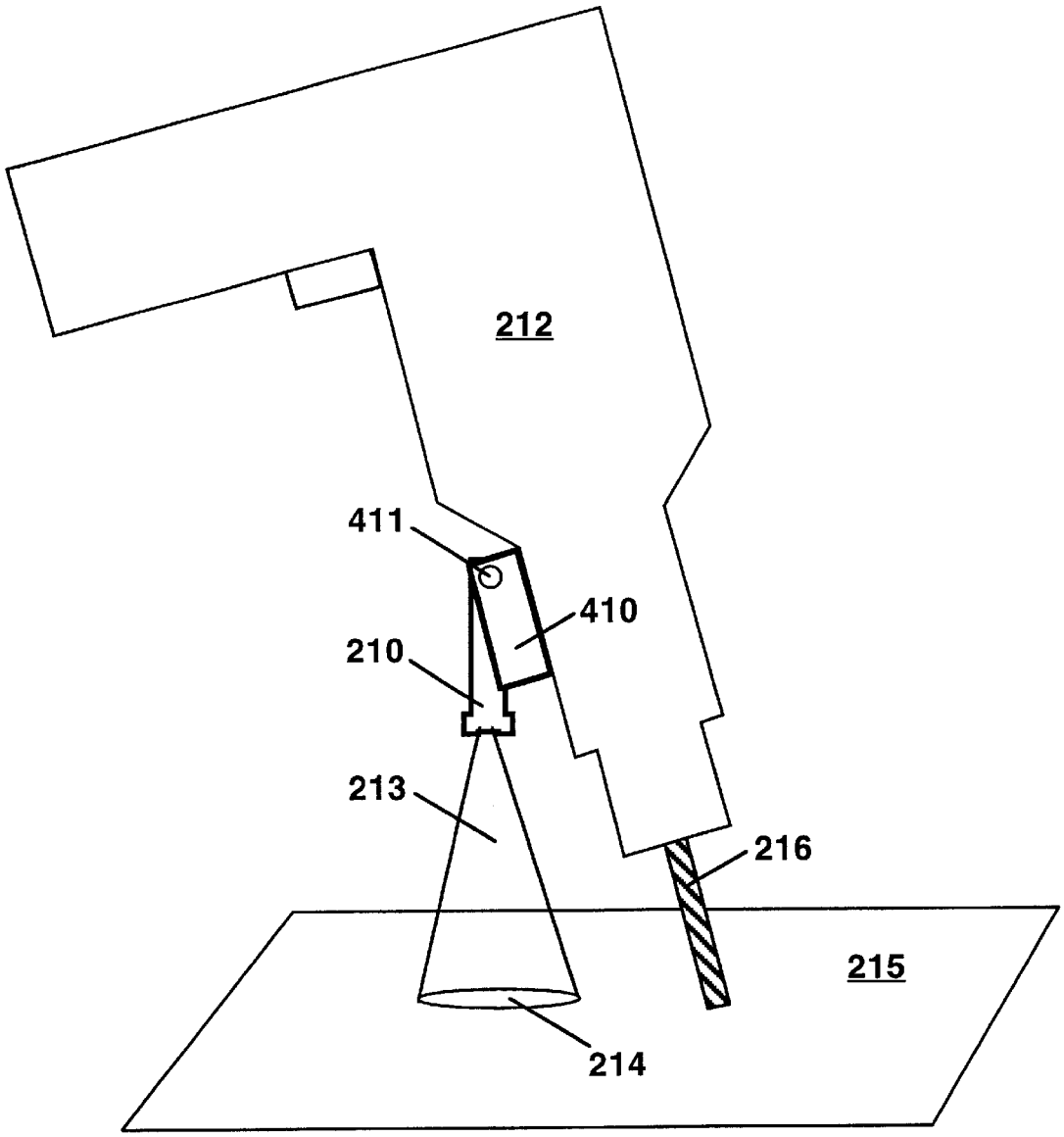
FIG. 4 depicts a projector according to the present invention that is pivotally mounted to an electric drill for drilling holes at various angles to the workpiece surface.

FIG. 4 depicts a projector 210, according to the present invention, that is mounted to an electric drill 212 via a pivot 411 and a bracket 410 to permit holes to be drilled at desired angles to workpiece surface 215. Pivot 411 may be any mechanical pivot, a pin or rod and mating holes, for example. As those skilled in the art will appreciate, the assembly comprised of projector 210, bracket 410 and pivot pin 411 may include a reference mark and calibration marks to facilitate adjustment for drilling holes at a specific angle. Bracket 410 may be attached to drill 212 by any suitable means, a screw, for example. The axes of projector 210 and drill bit 216 should remain in the same plane when projector 210 is pivoted. In order to drill a hole at a desiredangle, projector 210 is pivoted until light beam 213 impinges workpiece surface 215 perpendicularly when drill bit 216 is at the desired angle to workpiece surface 215. In this case, projected image 214 is substantially undistorted. Projector 210 may be maintained in the desired position by friction at pivot 411, which may be adjustable. For example, pivot 411 may include a pivot pin with a threaded end that screws into a hole in bracket 410 so as to vary the friction holding projector 210 at a given position. Alternatively, a locking device, a set screw, for example, may be used to maintain projector 210 in the desired position with respect to bracket 410.

Figure 5:
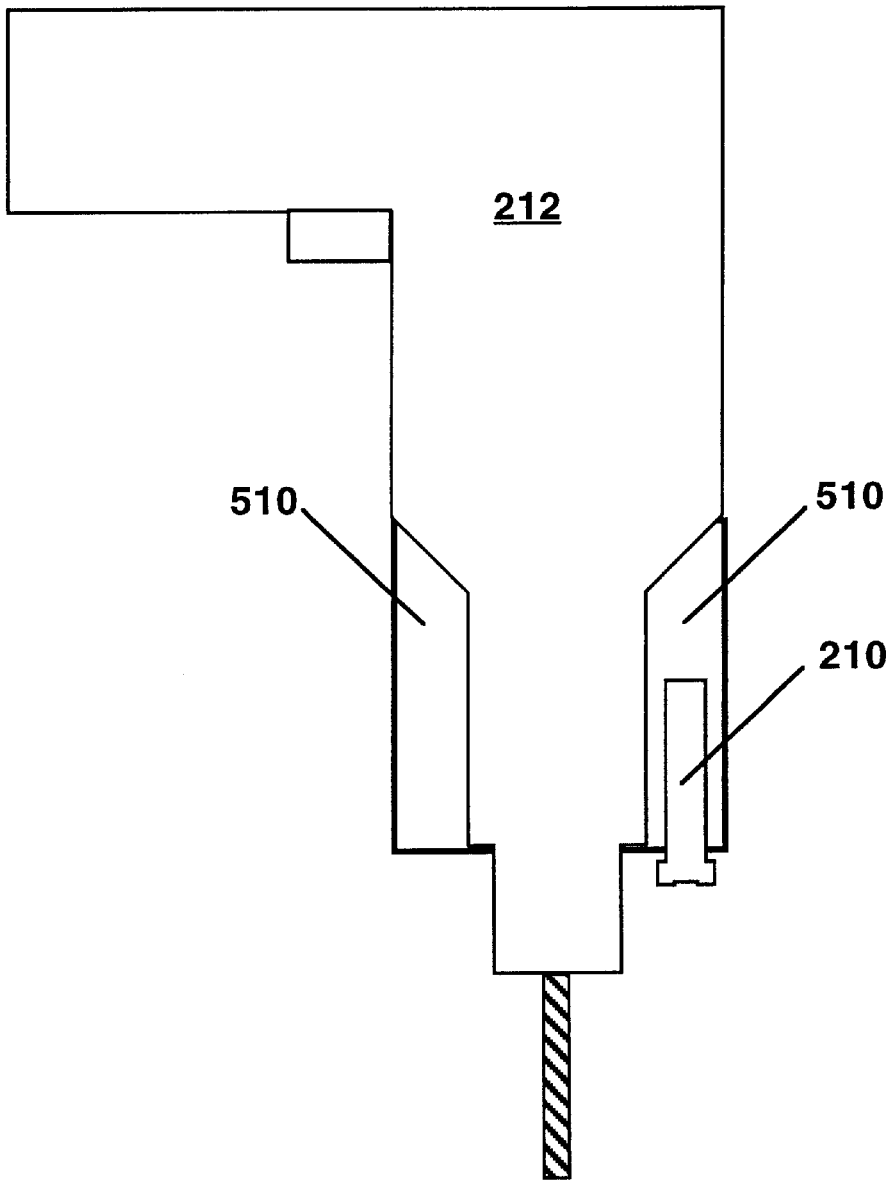
FIG. 5 depicts a projector according to the present invention that is mounted to an electric drill via a sleeve that can readily be attached to and removed from the drill.

FIG. 5 depicts a projector 210, according to the present invention, that is mounted to an electric drill 212 via a sleeve 510 that can readily be attached to and removed from the drill. Sleeve 510 is preferably molded or machined plastic but may be made of other materials or by other methods. The inside of sleeve 510 conforms to at least a portion of the outer surface of drill 212 so as to make a rigid connection. A set screw, locking tab or other device may be provided to lock sleeve 510 in place on drill 212. Projector 210 may slip or press fit into a hole or slot on sleeve 510 or may be an integral part of sleeve 510. A set screw, locking tab or other device may be provided to lock projector 210 in place in sleeve 510.

FABRICATION OF A PREFERRED EMBODIMENT

EXAMPLE 1

A working projector device according to the present invention was fabricated using a small cylindrical flashlight (SOLITAIREMAG) about 0.5 inch in outside diameter and 3.25 inches long and employing a cylindrical incandescent bulb about 0.12 inch in outside diameter. The reflector supplied with the flashlight was replaced with one of stainless steel having a spherical reflector surface of 0.250 inch radius of curvature and an axial hole through which the bulb was inserted. The template used to project the image was cut (using a 0.012 inch diameter end mill bit) into the flat surface of an acrylic plastic lens (0.425 inch diameter and 0.062 inch maximum thickness) having a concave surface (facing the bulb) with a radius of curvature of 0.584 inch. The machined grooves in the template were v-shaped (60° angle) and 0.005 inch deep, and were filled with black wax to improve the image contrast. The template image was comprised of two concentric circles (0.260 and 0.213 inch diameters) and two perpendicular straight lines of equal length whose midpoints corresponded to the center of the image circles. This image was the same as that depicted in FIG. 3(A) except that the straight lines were contained within the smaller circle. The image lines were 0.180 inch in overall length and had 0.040-inch discontinuities at their midpoints. The projector was mounted onto a hand drill using a sleeve as depicted in FIG. 5. When the end of the projector was 3.75 inch from the workpiece surface, the projected image was about 8 inches in diameter.

EXAMPLE 2

Reproducibility of the results for the device from Example 1 was determined by using the device to drill 40 holes (0.25 inch in diameter) at a nominal 90° angle to the surface of a piece of wood mounted on a wall. A drill bit was inserted into each hole and two orthogonal measurements of its angle relative to the wood surface were made using a protractor. Deviations of successive measurements from the target value of 90° were:

| | | | | | | | | | |
|---|---|---|---|---|---|---|---|---|---|
| 1 | 0.5 | 1 | 1.5 | 0.5 | 0.5 | 1.5 | 2 | 2 | 2 |
| 0.5 | 1 | 2 | 1 | 1 | 1 | 1 | 0.5 | 0.25 | 0.25 |
| 0.25 | 1 | 1 | 2 | 0 | 0.25 | 1 | 1 | 1 | 0.5 |
| 0.25 | 1 | 0.25 | 2 | 0.25 | 0 | 1.5 | 1 | 2 | 0.25 |

The average deviation was only 0.9° for these measurements.

The preferred embodiments of this invention have been illustrated and described above. Modifications and additional embodiments, however, will undoubtedly be apparent to those skilled in the art. Furthermore, equivalent elements may be substituted for those illustrated and described herein, parts or connections might be reversed or otherwise interchanged, and certain features of the invention may be utilized independently of other features. Consequently, the exemplary embodiments should be considered illustrative, rather than inclusive, while the appended claims are more indicative of the full scope of the invention.

I claim:

1. A device for aligring a tool with respect to a workpiece, comprising:

a light source;

a template of an image to be projected, wherein said template comprises an image pattern on a transparent or translucent glass or plastic material; and a means for attaching said light source and said template to the tool, whereby an image is projected onto a surface of the workpiece and is used to assess the orientation of the tool with respect to the surface of the workpiece.

2. The device of claim 1, wherein the tool is a hand drill.

3. The device of claim 1, wherein said light source is selected from the group consisting of incandescent bulb, fluorescent bulb, laser, and light emitting diode (LED).

4. The device of claim 1, further comprising a housing for said light source and said template.

5. The device of claim 4, wherein said housing includes a cylindrical surface.

6. The device of claim 4, further comprising a transparent or translucent end piece for said housing.

7. The device of claim 4, wherein said light source and said template are attached to said housing and said housing is attached to the drill.

8. The device of claim 7, wherein said housing is pivotally attached to the drill.

9. The device of claim 8, further comprising a reference mark and a calibration mark for determining the angle of the tool with respect to the surface of the workpiece.

10. The device of claim 1, wherein the image pattern is formed by scribing, drilling, cutting, etching, printing, stenciling, stamping, molding or combinations thereof.

11. The device of claim 1, wherein the image pattern comprises an ink or pigment applied to the glass or plastic material.

12. The device of claim 1, wherein the image includes a circle.

13. The device of claim 12, wherein the image further includes a continuous or discontinuous straight line whose midpoint corresponds with the center of the circle.

14. The device of claim 1, further comprising a curved reflector to intensify, collimate or focus light from said light source used to project the image.

15. The device of claim 1, further comprising a lens for focusing or adjusting the size of the projected image.

16. A device for aligning a tool with respect to a workpiece, comprising:

a light source;

a template of an image to be projected, wherein said template comprises an image pattern on a transparent or translucent glass or plastic material;

a housing containing said light source and said template; and a means for attaching said housing to the tool, whereby an image is projected onto a surface of the workpiece and is used to assess the orientation of the tool with respect to the surface of the workpiece.

17. A method for aligning tool with respect to surface of a workpiece, comprising the steps of:

(1) attaching a projector comprised of a light source and a template to the tool, wherein said template comprises an image pattern on a transparent or translucent glass or plastic material;

(2) projecting an image onto a surface of the workpiece; and (3) adjusting the orientation of the tool with respect to the workpiece until a substantially undistorted image corresponding to the desired orientation between the tool and the workpiece is observed.

18. The method of claim 17, wherein the tool is a hand drill.

19. The method of claim 17, further comprising the step of:

(4) adjusting the size of the image projected onto a surface of the workpiece.

* * * * *